United States Patent [19]

Adams

[11] Patent Number: 4,497,139

[45] Date of Patent: Feb. 5, 1985

[54] APPARATUS FOR PRECISION GRINDING OF END MOUNTED OBJECTS

[75] Inventor: Clarence R. Adams, Kirkland, Wash.

[73] Assignee: The Boeing Company, Seattle, Wash.

[21] Appl. No.: 640,202

[22] Filed: Aug. 9, 1984

Related U.S. Application Data

[63] Continuation of Ser. No. 374,722, May 4, 1982, abandoned.

[51] Int. Cl.[3] ..... B24B 3/02

[52] U.S. Cl. ..... 51/95 LH; 51/165.9; 51/225; 51/233; 51/288; 76/82; 409/63; 91/6

[58] Field of Search ..... 51/92 R, 95 R, 95 LH, 51/95 WH, 165.9, 122, 123, 219 R, 219 PC, 225, 233, 232, 288; 76/82, 85, 101 A; 91/6, 19, 31; 269/58, 71; 384/99, 115, 120; 409/63; 173/57

[56] References Cited

U.S. PATENT DOCUMENTS

| | | | |
|---|---|---|---|
| 880,120 | 2/1908 | Blessing | 51/122 X |
| 1,725,302 | 8/1929 | Riddle et al. | 269/58 |
| 2,850,849 | 9/1958 | Babbitt | 51/95 LH |
| 3,774,556 | 11/1973 | Poll | 173/57 X |
| 3,894,476 | 7/1975 | Cobb | 91/6 |

FOREIGN PATENT DOCUMENTS

| | | | |
|---|---|---|---|
| 2502666 | 8/1976 | Fed. Rep. of Germany | 91/6 |

*Primary Examiner*—Robert P. Olszewski
*Attorney, Agent, or Firm*—Delbert J. Barnard; Joan H. Pauly

[57] ABSTRACT

A tool (15) to be ground is mounted in a vertical position to the upper end of a vertically oriented piston (21). The lower end of the piston (21) is received into the open end of a cylinder (22). Radial fluid bearings (28, 29) are pressurized to permit rotational and longitudinal movement of the piston (21) with respect to the cylinder (22). Pressurized fluid is delivered to the piston (21) to exert a force on the piston (21) that nearly counterbalances the combined weight of the piston (21) and the tool (15). Additional fluid pressure or some other suitable force is applied to move the piston (21) and the tool (15) axially upwardly. At the end of the upward stroke, the additional force on the piston (21) is removed to allow said combined weight to move the piston (21) and the tool (15) downwardly. During the upward stroke, the downward stroke, or both the upward and the downward strokes, a grinding wheel (13) is held in a fixed position to contact a side surface of tool (15). Rotational movement of tool (15) may be produced and guided by finger (18) as the tool (15) is moving axially and is in contact with the grinding wheel (13). The bearings (28, 29) may be carried by the piston (21) or by the cylinder (22).

25 Claims, 8 Drawing Figures

Fig. 4
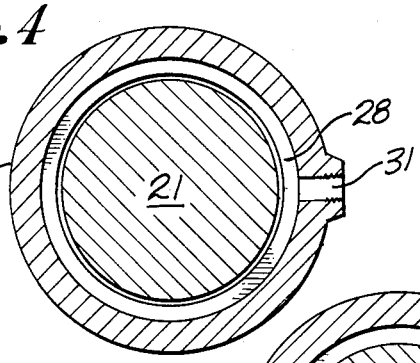
Fig. 5
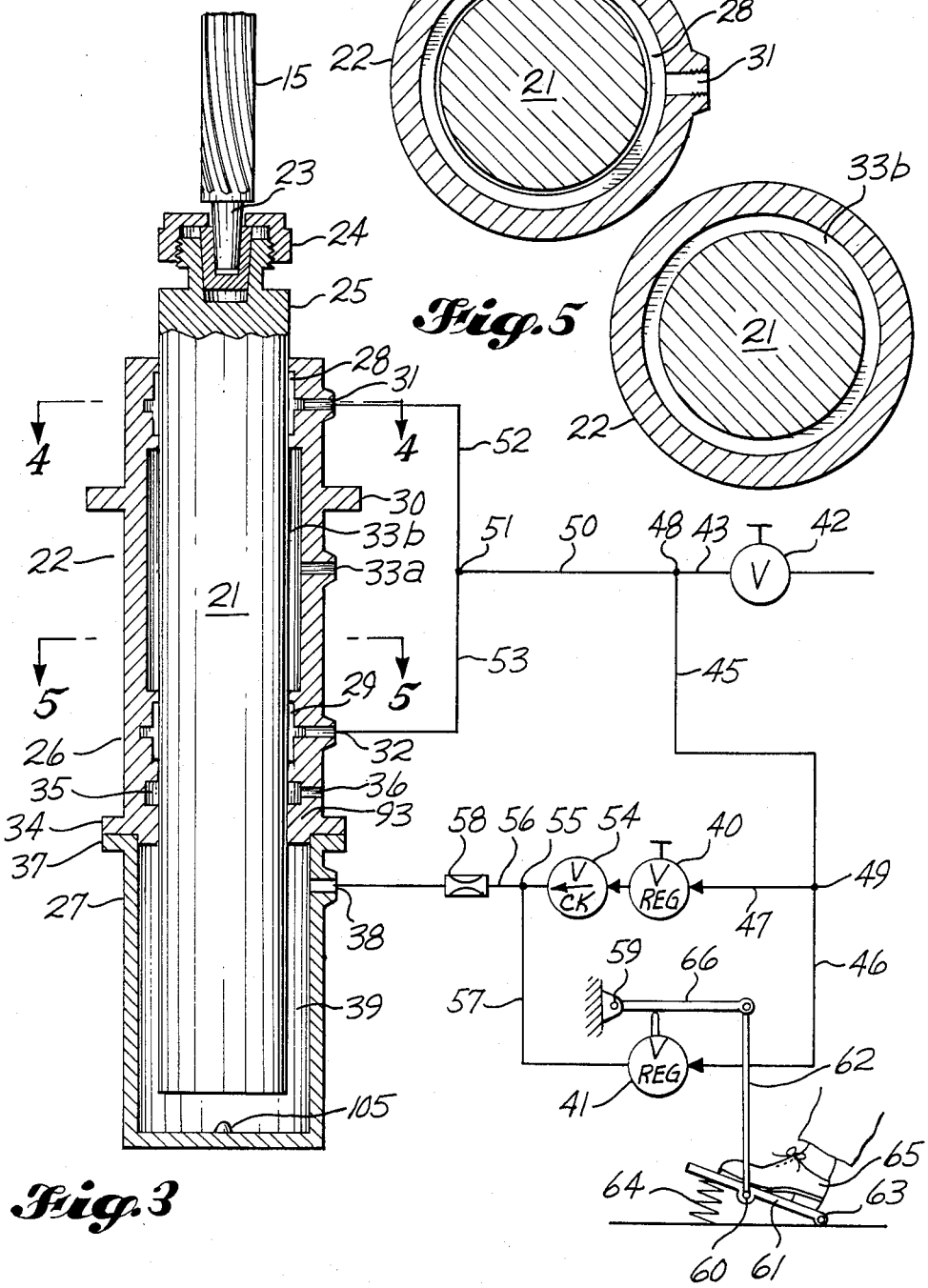
Fig. 3

APPARATUS FOR PRECISION GRINDING OF END MOUNTED OBJECTS

This application is a continuation of application Ser. No. 374,722, filed May 4, 1982, now abandoned.

TECHNICAL FIELD

This invention relates to methods and apparatus for precision grinding of objects and, more particularly, to a method and apparatus for grinding the cutting edges of end mounted tools, and the like, by mounting the tool or other object on one end of a vertical shaft and moving the tool or object vertically past a stationary grinding wheel.

BACKGROUND ART

It is well known that precision manufacturing processes, such as precision metal working, require that the tools used be made of hard, tough material which will maintain sharp, accurate cutting edges for as long as possible for economic reasons. It is also well known that grinding is the most effective means for shaping and sharpening the cutting edges of these hard, tough tools. The advent of computer control of machines has greatly enhanced the benefits of more precise tooling and longer lasting tooling.

Certain types of rotating cutting tools have a mounting shank at one end only and, therefore, can be supported at one end only, during manufacture, during subsequent maintenance, and during use. This is because the unsupported ends of these tools, as well as the sides, include cutting edges and therefore must be accessible. The primary object of the present invention is to provide an improved method and apparatus for the manufacture and maintenance of such end mounted precision rotary cutting tools.

In conventional tool grinding apparatus for end mounted rotary cutting tools, the tool is mounted horizontally with the cutting end essentially unsupported. Thus, the tool's weight creates a continuously changing overhanging moment reacting against the bearings as the tool is moved horizontally past the grinding wheel. The tool grinding apparatus disclosed in Homberg's U.S. Pat. No. 2,035,163 exemplifies well known prior art in this field. Increasing demands for tool grinding accuracy led to improvements in tool grinding apparatus by applying pressurized fluid film bearings, such as those shown in U.S. Pat. No. 3,112,140, issued to C. R. Adams. Air is used as the bearing fluid in most tool grinding apparatus; however, other gases and liquids (such as water or oil) can be used. Increases in the size and/or length of end mounted cutting tools necessitated further improvements to alleviate the effect of the greater overhanging moments encountered with the horizontally positioned, long and/or heavy tools. The invention of U.S. Pat. No. 3,432,213, "Self-Leveling Air Bearing Fixture", issued to C. R. Adams, is an example of such further improvements and was made in response to the need to reduce the effects of the overhanging loads. However, the continued requirement for improvements in manufacturing technology based on the economic benefits obtainable using computer techniques and, in some cases, larger tools has again created a need for greater accuracy in the shaping and sharpening of larger, longer end mounted tools. Known tool grinding apparatus does not meet this need, largely because of the inaccuracies resulting from the greater overhanging moments produced by the horizontally mounted longer, heavier tools. A tilt as small as 0.0002 inch can create unacceptable inaccuracies in the grinding of long, large tools.

DISCLOSURE OF THE INVENTION

A subject of this invention is a method and apparatus for supporting an object while it is being dressed and for moving the object relative to dressing means positioned to be contacted by a side portion of the object during axial travel of the object. An example of a more specific application of the method and apparatus of this invention is a method and apparatus in which a tool element is supported while it is being ground and is moved relative to a grinding element.

According to a basic aspect of the invention, the apparatus comprises a vertically oriented support assembly that includes a piston member, and a cylinder member having an open end into which the piston member is received. One of these members is movable, and the other of these members is fixed. The apparatus also includes mounting means for securing the object in a vertical position to an outer end portion of the movable member. Supply means are provided for supplying pressurized fluid to the movable member to exert a force on the movable member that is less than the combined weight of the movable member and the object secured thereto by a predetermined amount to thereby counterbalance a portion of said combined weight. Also provided are moving means for moving the movable member and the object axially upwardly, and leak means for allowing the pressurized fluid supplied to the movable member to leak away from the movable member. There are pressurized fluid bearing means between the piston member and the cylinder member. Preferably, the piston member is movable, and the cylinder member is fixed.

According to another basic aspect of the invention, the apparatus comprises a vertically oriented piston, mounting means for securing the object to be dressed in a vertical position to one end of the piston, and a cylinder having an open end into which the piston is received. The piston is received into said open end with said one end of the piston projecting outwardly from the open end of the cylinder. The apparatus also includes supply means for supplying pressurized fluid to the piston, said supply means having first and second modes, and leak means for allowing the pressurized fluid to leak away from the piston. When the supply means is in its first mode, the pressurized fluid exerts a force on the piston that is sufficient to overcome the combined weight of the piston and the object and to move the piston and the object axially upwardly. When the supply means is in its second mode, the pressurized fluid exerts a force on the piston that is less than said combined weight by a predetermined amount, to counterbalance a portion of said combined weight, and to allow said combined weight to move the piston and the object axially downwardly at a controlled rate. Preferably, the apparatus further comprises pressurized fluid bearing means between the piston and the cylinder. Also preferably, the fluid bearing means comprises at least two axially spaced paired step air bearings.

According to another aspect of the invention, the mounting means is positioned to secure the object to said one end of the piston with the longitudinal axis of the object coincident with the axis of the piston. In addition, the apparatus further comprises guide means for producing and guiding rotational movement of the object during axial travel of the object.

This aspect of the invention increases the efficiency and versatility of the invention and, for example, is especially useful in the shaping and sharpening of spiral cutting blades on the side surface of an end mounted rotary cutting tool.

According to another aspect of the invention, the supply means supplies pressurized fluid to a chamber located between the cylinder and the end of the piston opposite said one end of the piston to which the object is secured. Embodiments of the invention that include this aspect of the invention obviously are intended to be installed with said one end of the piston and the object projecting upwardly and outwardly from the cylinder. Of course, it is also possible to orient the apparatus with said one end of the piston and the object projecting outwardly and downwardly from the cylinder.

According to a preferred aspect of the invention, the supply means includes restrictor means to control the rate of increase in pressure of the pressurized fluid supplied to the piston.

According to another basic aspect of the invention, the apparatus comprises a vertically oriented support assembly that includes a piston member, and a cylinder member having an open end into which the piston member is received. One of these members is movable, and the other of these members is fixed. Means are provided on an outer end portion of the movable member for receiving a tool element to be ground with the axis of the tool element disposed vertically. Also provided are means for delivering pressurized fluid between the piston member and the cylinder member, for moving the movable member and the tool element carried thereby axially. There are also pressurized fluid bearing means between the piston member and the cylinder member.

According to still another basic aspect of the invention, the apparatus comprises a vertically disposed cylinder having an open end, a piston within the cylinder having an outer end portion which projects outwardly from the open end of the cylinder, and means on the outer end portion of the piston for receiving a tool element to be ground with the axis of the tool element disposed vertically. The apparatus also includes means for delivering pressurized fluid between the piston and the cylinder, for moving the piston and the tool element carried thereby axially, and pressurized fluid bearing means between the piston and the cylinder. Preferably, the fluid bearing means comprises at least two axially spaced paired step air bearings.

According to a preferred aspect of the last described basic aspect of the invention, the apparatus further comprises leak means for allowing the pressurized fluid delivered between the piston and the cylinder to leak away from the piston, and the means for delivering pressurized fluid has first and second modes. When the means for delivering is in its first mode, the pressurized fluid exerts a force on the piston that is sufficient to overcome the combined weight of the piston and the tool element carried thereby and to move the piston and the tool element axially upwardly. When the means for delivering is in its second mode, the pressurized fluid exerts a force on the piston that is less than said combined weight by a predetermined amount, to counterbalance a portion of said combined weight, and to allow said combined weight to move the piston and the tool element axially downwardly at a controlled rate.

Other preferred features that may be included individually or in combination have been described above. These include positioning the tool element on the piston with their longitudinal axes coincident and providing means for producing and guiding rotational movement of the tool element, and providing restrictor means to control the rate of increase in pressure of the pressurized fluid being delivered.

The pressurized fluid bearing means between the piston and the cylinder may be carried by the piston, or it may be carried by the cylinder. In embodiments in which the fluid bearing means is carried by the cylinder, it is preferable for the piston to have a smooth cylindrical outer surface adjacent to inner portions of the cylinder and for the fluid bearing means to be carried by said inner portions of the cylinder. Such embodiments also preferably further include leak means comprising an exhaust passageway extending through a wall portion of the cylinder, and a land portion of the cylinder. Such land portion of the cylinder has a first end adjacent to a chamber which is located between the cylinder and the piston and to which the supply means supplies pressurized fluid, and a second end adjacent to the exhaust passageway.

In embodiments in which the fluid bearing means is carried by the piston, it is preferable that the cylinder have a smooth cylindrical inner surface adjacent to outer portions of the piston and for the fluid bearing means to be carried by said outer portions of the piston. Such embodiments are also preferably provided with leak means that includes an exhaust passageway extending through the piston, and a land portion of the piston. This land portion has a first end adjacent to a chamber which is located between the cylinder and the piston and to which the supply means supplies pressurized fluid. The land portion also has a second end adjacent to one end of the exhaust passageway.

According to a preferred aspect of embodiments of the invention in which the fluid bearing means is carried by the piston, the apparatus further comprises means for supplying pressurized fluid to the fluid bearing means. This means for supplying pressurized fluid includes a supply passageway extending through the piston and communicating with the fluid bearing means. The supply passageway has a receiving end extending through a side portion of the piston adjacent to said one end of the piston. The means for supplying also includes an annular gland rotatably mounted on the piston. This gland includes passageway means communicating with said receiving end of the supply passageway, means to connect a supply line to communicate with said passageway means, and pressurized fluid bearing means to allow essentially friction free rotational motion of the piston relative to the gland.

According to a basic method aspect of the invention, a method of dressing an object comprises securing the object in a vertical position to one end of a vertically oriented support member. Pressurized fluid is supplied to the support member to exert a force on the support member that is less than the combined weight of the support member and the object secured thereto by a predetermined amount to thereby counterbalance a portion of said combined weight. While said combined weight is being so counterbalanced, the support member and the object are moved axially upwardly. The pressurized fluid being supplied to the support member is allowed to leak away from the support member, and said combined weight is allowed to move the support member and the object axially downwardly. While the object is moving axially, dressing means are held in a fixed position to contact a side portion of the object. Preferably, the method further comprises pressurizing radial fluid bearing means to support the support member and the object secured thereto, and maintaining the pressurization of the fluid bearing means while the object is being moved.

According to another basic method aspect of the invention, a method of dressing an object comprises securing the object in a vertical position to one end of a vertically oriented support member. Pressurized fluid is supplied to the support member to exert a force on the support member that is less than the combined weight of the support member and the object secured thereto by a predetermined amount to thereby counterbalance a portion of said combined weight. Additional fluid pressure is supplied to the support member to exert a force that is sufficient to overcome said combined weight and to move the support member and the object axially upwardly. The force of the pressurized fluid on the support member is reduced so that said combined weight exceeds said force by a predetermined amount. The pressurized fluid being supplied to the support member is allowed to leak away from the support member, and said combined weight is allowed to move the support member and the object axially downwardly. While the object is moving axially, dressing means is held in a fixed position to contact a side portion of the object.

Preferably, the step of holding the dressing means in a fixed position is performed while the support member and the object are moving axially upwardly. Also preferably, the method further comprises pressurizing fluid bearing means surrounding the support member after so securing the object, and maintaining the pressurization of the fluid bearing means while the object is being moved. It is also preferable that the object be secured to the support member with its longitudinal axis coincident with the longitudinal axis of the support member and that the method further comprise producing and guiding rotational movement of the object while so holding the dressing means.

According to still another basic method aspect of the invention, a method of grinding a tool element comprises securing the tool element in a vertical position to one end of a vertically oriented piston, and pressurizing fluid bearing means surrounding the piston and maintaining the pressurization of the fluid bearing means. While the pressurization of the fluid bearing means is being so maintained, pressurized fluid is delivered to the piston to move the piston and the tool element carried thereby axially. While the tool element is moving axially, a grinding element is held in a fixed position to contact a side portion of the tool element.

The step of delivering pressurized fluid to the piston preferably comprises the steps of supplying pressurized fluid to exert a force on the piston that is less than the combined weight of the piston and the tool element carried thereby by a predetermined amount to thereby counterbalance a portion of said combined weight, increasing the fluid pressure on the piston to exert a force that is sufficient to overcome said combined weight and to move the piston and the tool element axially upwardly, and reducing the force of the pressurized fluid on the piston so that said combined weight exceeds said force by a predetermined amount. The method further comprises, after so reducing said force, allowing the pressurized fluid being delivered to the piston to leak away from the piston, and allowing said combined weight to move the piston and the tool element axially downwardly. Also preferably, the step of holding the grinding element is performed while supplying pressurized fluid to exert a force on the piston sufficient to overcome said combined weight and to move the piston and the tool element.

The apparatus and method of the present invention provide a simple, efficient, and inexpensive means for dressing objects, and especially for precision grinding heavy and/or long cutting tools. The vertical orientation of the supporting structure and the object being dressed overcomes the problems, encountered in the use of the known apparatus and methods, that result from the overhanging moments produced by the weight of a horizontally positioned cutting tool or other object. The accuracy of the apparatus and method of the invention is enhanced by the use of fluid bearings between the piston and the cylinder. These fluid bearings support the piston in a vertical position and allow both longitudinal and rotational movement of the piston relative to the cylinder. The only unbalanced radial force on the object being dressed and the supporting piston is the force that results from the contact between the dressing means, or grinding element, and the object or tool being dressed or ground. This force is essentially constant when the dressing or grinding process is taking place and is of a small enough magnitude that the fluid bearings can easily carry the load and hold the object and the piston in a precisely vertical position. The method and apparatus of this invention are designed to take maximum advantage of currently available fluid bearing technology.

In embodiments of the invention which include pressurized fluid bearings and in which pressurized fluid is first supplied to counterbalance a portion of the combined weight of the support member and the object, the precision of the control of the rate of movement of the support member and the object, and thus the precision of the dressing or grinding process, is greatly enhanced. Since the pressurized fluid bearings have essentially zero breakaway friction, only a small additional force is needed to move the support member and the object axially upwardly and the movement is gradual and controlled. There is no sudden burst of upward movement that would occur if breakaway friction had to be overcome.

Each of the two alternatives discussed above for locating the fluid bearing means, namely locating them so that they are carried either by the piston or by the cylinder, has its own advantages. When the fluid bearing means is carried by the cylinder, there is no need to provide a feature like the gland discussed above to supply pressurized fluid to the fluid bearing means. In addition, the portion of the cylinder with the precision ground, bearing-carrying surface can be made shorter than a corresponding portion of a piston and be attached to a lower portion or end cap that does not require grinding. On the other hand, it is easier to manufacture the apparatus of the invention when the fluid bearing means is carried by the piston since bearing steps must be concentric and are normally from 0.0002 to 0.0010 inches high.

Another subject of this invention is an apparatus for delivering pressurized fluid from a nonrotating supply system to a fluid passageway in an axially rotating cylindrical element. According to an aspect of the invention that relates to this subject, a swivel gland comprises an essentially annular housing rotatably mounted on the cylindrical element. Supply passageway means extends through the housing and communicates with a receiving end of the fluid passageway in the cylindrical element. Means is provided to connect a supply line to the housing to communicate with the supply passageway means. Also provided is pressurized fluid bearing means to allow essentially friction free rotational motion of the cylindrical element relative to the swivel gland. The fluid bearing means is pressurized by the pressurized fluid being delivered to the fluid passageway in the cylindrical element. The fluid bearing means comprises a radial fluid film bearing and a fluid film thrust bearing. Preferably, the supply passageway means communicates directly with the radial fluid film bearing to pressurize said radial bearing, and the thrust bearing is pressurized by pressurized fluid leaking from the radial bearing to the thrust bearing. Also preferably, the radial bearing is a radial paired step air bearing, and the thrust bearing is a stepped air thrust bearing.

The swivel gland with the pressurized fluid bearing means has several advantages over conventional swivels containing sealing means to prevent leakage of the pressurized fluid being delivered. The radial fluid film bearing causes the swivel gland to automatically center itself when pressurized fluid is being delivered. Therefore, even though it is necessary to allow the gland to leak in order to make the bearings function properly, there is less leakage than there would be in a swivel with sealing means because the gap between the swivel gland and the cylindrical element is extremely small at all points around the circumference of the cylindrical element. The automatic centering of the swivel gland also avoids the unnecessary friction that is produced when a swivel is not centered. In addition, since there is a film of fluid between all the adjacent surfaces of the swivel gland and the cylindrical element, there is essentially zero breakaway rotational frictional restraint between the swivel gland and the cylindrical element as well as essentially zero rotational frictional restraint. Considering the great advantages of this construction of the swivel gland, it should be obvious that it could be advantageously used in any application in which there is a need for delivering pressurized fluid from a nonrotating supply system to a fluid passageway in an axially rotating cylindrical element. One such application is the dressing or grinding process described above.

These and other features and advantages will become apparent from the detailed description of the best modes for carrying out the invention that follows.

BRIEF DESCRIPTION OF THE DRAWINGS

In the drawings, like element designations refer to like parts throughout, and:

FIG. 3 is a sectional view of the embodiment shown in FIG. 1, showing the lower portions of the piston and a milling cutter mounted on the piston in plan and including the fluid pressure supply and control equipment shown schematically.

FIG. 4 is a cross-sectional view taken along the line 4—4 in FIG. 3.

FIG. 5 is a cross-sectional view taken along the line 5—5 in FIG. 3.

BEST MODES FOR CARRYING OUT THE INVENTION

The drawings show two embodiments of apparatus for precision grinding of end mounted objects. Both embodiments are constructed according to the invention and according to the requirements of the method aspects of the invention, and both also constitute the best modes of the invention and of the means for practicing the invention currently known to the applicant. The apparatus is designed to be used in situations such as that illustrated in FIG. 1, in which the lateral spiral cutting edges of an end mounted rotary milling cutter are being sharpened with a tool grinding machine that incorporates a preferred embodiment of the present invention.

Figure 1:
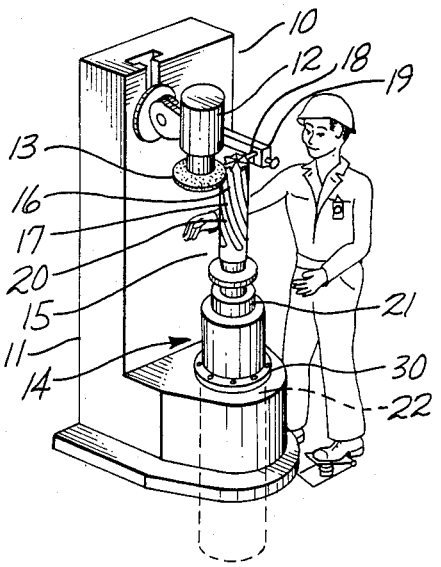
FIG. 1 is a pictorial view of a tool grinding machine incorporating a preferred embodiment of the invention, showing the machine in operation to sharpen the lateral spiral cutting edges of a milling cutter.

Referring to FIG. 1, the tool grinding machine 10 comprises a base 11, a grinding wheel drive motor 12 adjustably mounted on the base 11, and a grinding wheel 13, all of which form no part of the present invention and are shown and described herein solely for the purpose of illustrating a typical environment in which the method and apparatus of the present invention may be used. A tool support assembly 14, which is a part of the present invention, is mounted on the base 11. Tool 15, a milling cutter for example, is mounted in the support assembly 14. Briefly, the tool 15 is sharpened by being maneuvered past the appropriately positioned grinding wheel 13. In this example, it is maneuvered in a combined vertical and rotary motion to bring the cutting edges 16 of flutes 17 sequentially into contact with the grinding wheel 13. The rotary component in the example shown in FIG. 1 is produced and guided by means well known in the art; i.e. a guide finger 18 mounted on arm 19 engages the valleys 20 between flutes 17 one at a time in sequence and the rotary component of motion is produced by the camming action of the guide finger 18 in a valley 20.

The tool support assemblies 14 and 14', shown in FIGS. 1 and 2 and described in more detail below, comprise movable assemblies 21 and 21' and fixed assemblies 22 and 22'. The support assemblies 14, 14' are mounted into base 11 by flanges 30, 30' on fixed assemblies 22, 22'. The movable assemblies 21, 21' move telescopically and rotatably with respect to the fixed assemblies 22, 22', the movable assemblies 21, 21' essentially functioning as piston rods and the fixed assemblies 22, 22' as cylinders.

Referring to FIG. 3, shank 23 of a tool 15 is mounted in collet assembly 24 in the upper end of shaft 25 of movable assembly, or piston, 21. Such collet assemblies are well known in the art. Fixed assembly 2 is basically a cylinder 22 that has one open end and one closed end and that comprises cylinder 26 (with two open ends) and end cap 27, which closes the lower end of cylinder 26. Cylinder 26 includes paired step air bearing 28 (described in U.S. Pat. No. 3,112,140 and shown in FIG. 1 of that patent) at its upper end, paired step air bearing 29 at its lower end, mounting flange 30, air inlet 31 to bearing 28, air inlet 32 to bearing 29, exhaust air outlet 33*a*, end cap attachment flange 34, exhaust cavities 33*b* and 35, seal land 93, and exhaust outlet 36. Paired step air bearings 28 and 29 are essentially identical pressurized fluid film bearings and support piston 21 in a vertical position. End cap 27 completely encloses the lower end of piston 21 and is attached by any suitable conventional fasteners (not shown) at flange 37 to flange 34. Inlet fitting 38 provides fluid pressure to chamber 39 between end cap 27 of cylinder 22 and the lower end of piston 21 to provide an upward pressure force to support the weight of the movable piston assembly 21 and the tool 15 and, with controlled fluctuation of the pressure, to move the assembly 21 and the tool 15 up and down. Piston stop button 105 ensures that there is always a gap between the lower end of piston 21 and the inside bottom of the end cap 27 so that fluid pressure can build up under the lower end of piston 21 to counterbalance its weight and to move it upwardly.

Referring to FIG. 3 again, air or other fluid at relatively high pressure, such as 50 to 200 pounds per square inch, is delivered to inlets 31 and 32 for pressurizing bearings 28 and 29, respectively, via shut-off valve 42, line 43, tee connector 48, line 50, tee connector 51, and lines 52 and 53. Air or other fluid is delivered to regulator valves 40 and 41 via shut-off valve 42, line 43, tee connector 48, line 45, tee connector 49, and lines 46 and 47. Air or other fluid is delivered to inlet 38 from regulator valve 40 via check valve 54, tee connector 55, line 56, and restrictor orifice 58. The pressure delivered to inlet 38 from regulator valve 40 is regulated to provide a constant upward force on piston 21 equal to a predetermined large percentage (90 to 97% for example) of the combined weight of piston 21 and tool 15. Air or other fluid is also delivered to inlet 38 from regulator valve 41, via line 57, tee connector 55, line 56, and restrictor orifice 58. The pressure of the air from regulator valve 41 is adjusted over a range extending from a pressure below the pressure from regulator valve 40 to one high enough to cause movable piston 21 to rise (i.e. telescope) from fixed cylinder 22. Regulator valve 41 might be a needle valve, or any other type of valve that allows minor changes in pressure.

The pressure from regulator valve 41 is adjusted by motion of lever 66. Lever 66 is pivoted at point 59 and connected to point 60 on foot pedal 61 via link 62. Foot pedal 61 is pivoted at 63 and operated against the force of spring 64 by the operator's foot 65.

This is the preferred embodiment of the fluid pressure supply and control equipment. Of course, various modifications could be made and various other systems of equipment could be used without departing from the spirit and scope of the present invention.

In operation of the embodiment of FIG. 3, a tool 15 to be ground for shaping or sharpening is mounted in the collet assembly 24. Guide finger 19 (FIG. 1) is adjusted to engage a valley 20 on the tool 15, and grinding wheel 13 (FIG. 1) is adjusted to be in a fixed grinding position when the piston 21 and the tool 15 mounted thereon move up. Before such upward movement occurs, the grinding wheel 13 is above the tool 15 in close proximity but not in contact with the tool 15. Valve 42 is opened to admit high pressure air to inlets 31 and 32 and regulator valves 40 and 41. High pressure air at inlets 31 and 32 activates bearings 28 and 29, respectively. Regulator valve 40 is adjusted to produce a force at inlet 38 which is slightly less than the total combined weight of movable piston 21 and tool 15. Regulator valve 41 is adjusted to produce a force slightly greater than said total combined weight.

With the grinding wheel 13 operating, the machine is ready for operation. The operator, by depressing pedal 61, causes the pressure delivered by regulator valve 41 to increase the pressure delivered at port 38 to thereby lift the movable piston 21. Restrictor orifice 58 assures that the pressure increase will be gradual and that the operation of the support assembly 14 will not be overly sensitive to the operation of the foot pedal 61. It also assures that bearings 28 and 29 will be pressurized before any motion can occur because of pressure in chamber 39. Check valve 54 prevents air pressure from being applied in the reverse direction on regulator valve 40 when the pressure from regulator valve 41 exceeds the pressure for which regulator valve 40 is set. When the pressure from regulator valve 41 is high enough, the piston 21 rises and moves the tool 15 upward into grinding contact with the grinding wheel 13. As the tool 15 moves past the grinding wheel 13, the finger 18 produces rotational movement of the tool 15 and guides such movement so that a spiral cutting edge 16 of a flute 17 moves rotationally and axially in contact with the fixed grinding wheel 13.

At the end of this upward stroke, the operator relieves the foot pressure on pedal 61 and the pressure from regulator valve 41 falls below that from regulator valve 40. Leakage past seal land 93 into cavity 35 and out exit 36 allows the pressure force supporting piston 21 to reduce and the piston 21 to descend at a rate controlled by the pressure at which regulator valve 40 is set. The air leaking from bearings 28 and 29 escapes through exhaust cavities 33*b* and 35 and outlets 33*a* and 36 and the upper end of paired step bearing 28.

This description of the operation of the invention, as will be clearly obvious to those skilled in the art, is given purely as an example of the operation of a machine incorporating the subject invention. Obvious practices, such as grinding wheel speeds and feeds, familiar to those skilled in precision metal working have not been described. Various aspects of the operation that have been described may be varied without departing from the spirit and scope of the present invention. For example, the actual grinding could be done as the piston 21 and tool 15 are moving downwardly, instead of or in addition to when these elements are moving upwardly. Also, various fluids could be used for pressurizing the hydrostatic bearings 28 and 29 and for moving the supporting piston 21. These include any appropriate gas, such as air, or any appropriate liquid, such as water or oil. In addition, once the combined weight of the piston 21 and the tool 15 is nearly counterbalanced by the pressure from regulator valve 40, the piston 21 may be moved upwardly by applying additional fluid pressure (through regulator valve 41 or other suitable means), by hand, or by other mechanical means.

Figure 2:
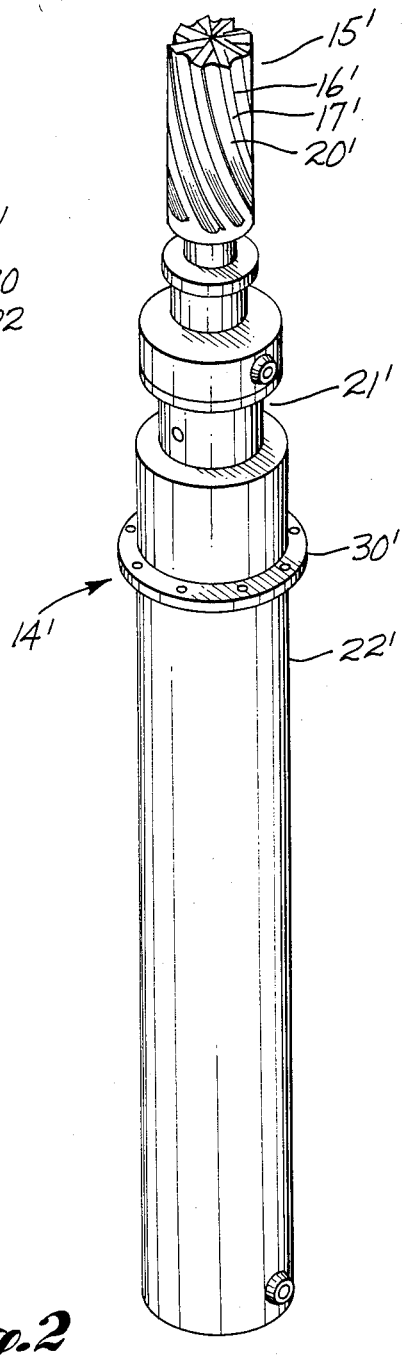
FIG. 2 is a pictorial view of the support structure, the piston and the cylinder, of another preferred embodiment, with a rotary milling cutter shown mounted on the piston.
Figures 6, 7, 8:
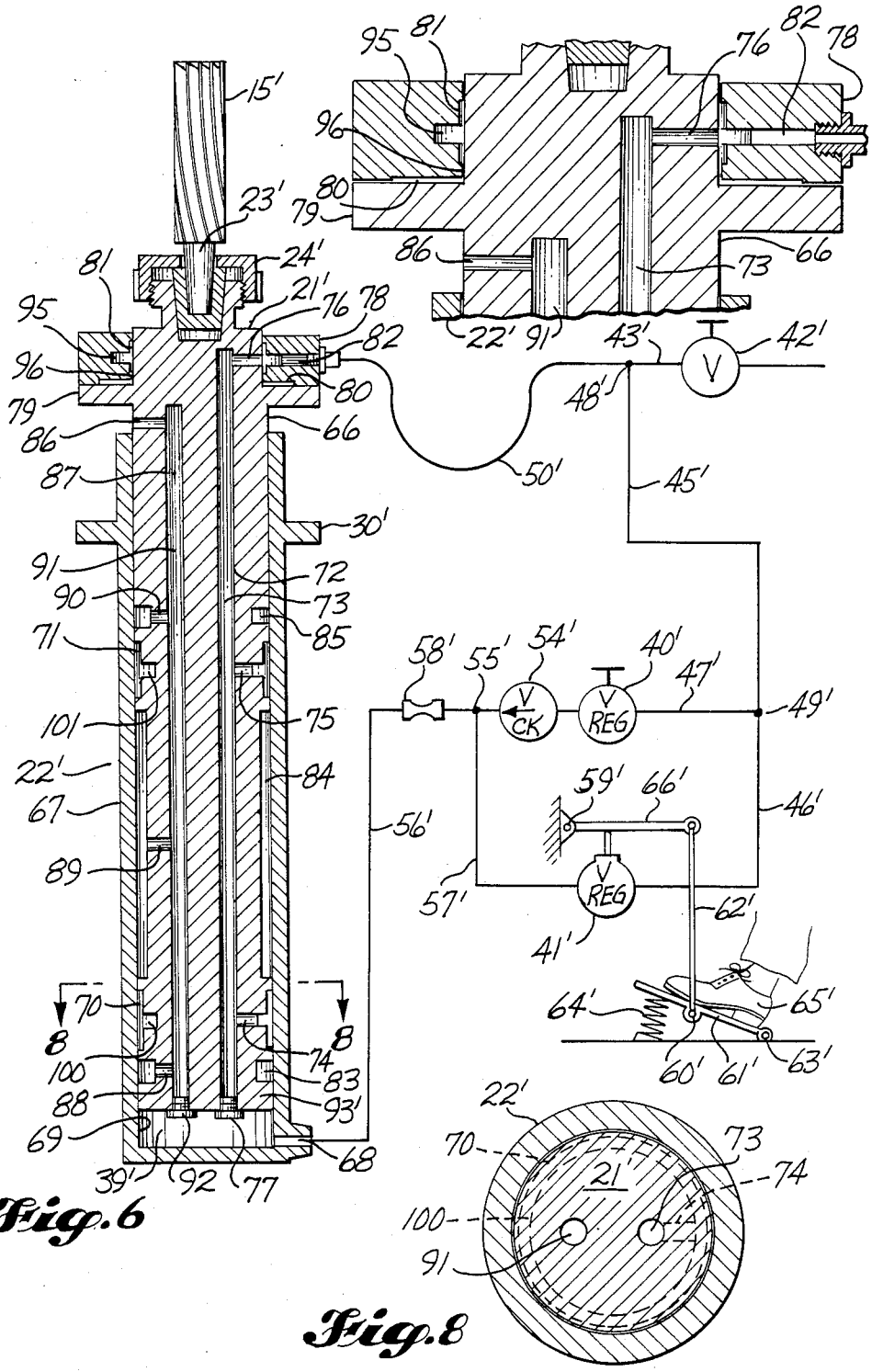
FIG. 6 is a sectional view of the embodiment of the invention shown in FIG. 2, showing in plan a milling cutter mounted on the piston and showing schematically the fluid pressure supply and control equipment.
FIG. 7 is a fragmentary enlarged sectional view of an upper portion of the piston and the gland mounted thereon as shown in FIG. 6.
FIG. 8 is a cross-sectional view taken along the line 8—8 in FIG. 6.

Referring to FIGS. 2 and 6, in which parts common to both embodiments have the same numbers as their counterparts in FIG. 3, but with a prime mark for FIGS. 2 and 6, shank 23' of a tool 15' is mounted in collet assembly 24' in the upper end of shaft 66 of movable assembly, or piston, 21'. Fixed assembly 22' comprises cylinder 67, which has a mounting flange 30' and an air inlet 68. The inner surface 69 of the cylinder 67 is a smooth, straight cylindrical bore that is open at one end (the upper end). Movable piston 21' is received into the cylindrical bore, and its lower end defines, with the lower end of the bore, a chamber 39'. Air inlet 68 communicates with the chamber 39'. Piston 21' is supported in a vertical position on surface 69 by two paired step fluid bearings 70 and 71. These bearings 70 and 71 are essentially identical, and they are described in U.S. Pat. No. 3,112,140 and are singly illustrated in FIG. 3 of that patent. In the embodiment shown in FIGS. 2 and 6, air is provided to the fluid bearings 70, 71 via manifold 72 in shaft 66, the manifold 72 comprising passageways 73, 74, 75, and 76. Passageway 73 is plugged at its lower end by plug 77. Air is delivered to manifold 72 via swivel, or gland 78, which provides a means of feeding air into the rotating piston 21' with minimal leakage. Plug 77 and plug 92, described below, perform the same stop function that the piston stop button 105 performs in the embodiment of FIG. 3.

Gland 78 is supported on flange 79, which is integral with shaft 66, by stepped air thrust bearing 80, as described in U.S. Pat. No. 3,119,639, FIG. 2, part 23*a*, and is piloted on shaft 66 by radial paired step air bearing 81. Use of a stepped air thrust bearing and a paired step air bearing on gland 78 assures that there is zero breakaway rotational frictional restraint between gland 78 and shaft 66. Gland 78 is prevented from moving upward by its own weight and gravity. Air is introduced into gland 78 at the inlet end of inlet passageway 82, which communicates with passageway 76 of manifold 72 and bearings 80 and 81. Suitable conventional means are provided for connecting flexible supply line 50' to the inlet end of passageway 82. The introduction of pressurized air into passageway 82 pressurizes bearing 81 via bearing manifold, or annulus, 95, bearing 80 via the clearance 96 between shaft 66 and bearing 81 that communicates bearings 80 and 81, and manifold 72 in shaft 66 via passageway 76. Manifold 72 supplies pressurized fluid to paired step bearings 70 and 71 through passageways 74 and 75 and bearing cavities, or annuli, 100 and 101, respectively.

Air leaking from bearings 70 and 71 escapes through annular grooves 83, 84, and 85 on the surface of piston 21' and is delivered to exhaust port 86 via exhaust manifold 87, which comprises passageways 88, 89, 90, and 91 and port 86. Plug 92 blocks the lower end of passageway 91. Passageways 88, 89, and 90 communicate exhaust port 86, via passageway 91, with grooves 83, 84, and 85, respectively.

Still referring to FIG. 6, air or other fluid at relatively high pressure for pressurizing air bearings 70 and 71 is delivered to inlet passageway 82 of gland 78 via line 50', tee connector 48', line 43', and shut-off valve 42'. Line 50' is flexible to accommodate the up and down motion of movable assembly 21'. Air is supplied to regulator valves 40' and 41'via shut-off valve 42', line 43', tee connector 48', line 45', tee connector 49', and lines 46' and 47'. Air at pressure is delivered to inlet 68 from regulator valve 40' via check valve 54', tee connector 55', restrictor orifice 58', and line 56'. Air is also delivered to inlet 68 from regulator valve 41' via line 57', tee connector 55', restrictor orifice 58', and line 56'. The pressure from regulator valve 41' is adjusted by motion of lever 66' or other suitable means. Lever 66' is pivoted at point 59' and connected to point 60' in foot pedal 61' via link 62'. Foot pedal 61' is pivoted at 63' and operated against the force of spring 64' by the operators's foot 65'.

The operation of the embodiment of FIGS. 2 and 6 is basically the same as the operation of the embodiment of FIGS. 1 and 3. A tool 15' to be ground for shaping or sharpening is mounted in the collet assembly 24'. A guide finger like the one shown in FIG. 1 is adjusted to engage a valley 20' between spiral flutes 17' on tool 15' and a grinding wheel like the one shown in FIG. 1 is adjusted to the proper fixed position to grind a cutting edge 16'. Valve 42' is opened to admit high pressure air to line 50' and regulator valves 40' and 41', which then deliver air at the required pressures to inlets 68 and 82. The pressurized air supplied at inlet 82 activates bearings 70 and 71, and the pressurized air supplied at inlet 68 produces the force required to control vertical movement of piston 21'.

With the grinding wheel operating, the machine is ready for operation. The operator, by depressing pedal 61', causes the pressure delivered by regulator valve 41' to increase, thus increasing the pressure delivered at inlet 68 and the force tending to lift the movable piston assembly 21'. Restrictor orifice 58' assures that the pressure increase will be gradual and that the operation of the support assembly 14' will not be overly sensitive to the operation of the foot pedal 61'. It also assures that air bearings 70 and 71 will be pressurized before there is enough pressure at inlet 68 to cause any motion of assembly 21'. Check valve 54' prevents air pressure from being applied in the reverse direction on regulator valve 40' when the pressure from regulator valve 41' exceeds the pressure for which regulator valve 40' is set. When the pressure from regulator valve 41' is high enough, the piston 21' rises and moves the tool 15' upward past the grinding wheel. At the end of this upward stroke, the operator relieves foot pressure on pedal 61', the pressure from regulator valve 41' falls below that from regulator valve 40', and leakage from chamber 39' past land 93' to exhaust groove 83 allows the pressure force supporting piston 21' to reduce and the piston to descend.

This description of the operation of the embodiment of FIGS. 2 and 6, like that of the embodiment of FIGS. 1 and 3, is given for illustrative purposes; and the various aspects may be similarly varied without departing from the spirit and scope of the invention.

From the above descriptions and discussion, it can be seen that the present invention provides a method and apparatus for precision grinding that offer significant improvement over known methods and apparatus. With the tool and its supporting assembly oriented vertically, there is no overhanging weight to overcome the stiffness of the fluid bearings and influence the accuracy of the positioning of the tool. To achieve similar accuracy with a long and/or heavy tool and a supporting assembly oriented in the conventional, horizontal position would be economically impractical even with a grinding fixture having considerably larger bearings and fluid bearing pressures many times higher. Such larger moving components would increase overhanging weight and, thus, bearing loads. Further, the space required for installation and operation would be excessive and expensive because of the larger size and the horizontal orientation. The increased grinding accuracy and the smaller size of the machine incorporating the subject invention, combined with the more efficient use of space allowed by the vertical orientation, clearly make possible simpler, more economical precision shaping and sharpening of large and/or long, end mounted cutting tools. In addition, these improvements are achieved using well known, proven bearing technology, such as that described in U.S. Pat. Nos. 3,112,140; 3,119,639; and 3,432,213. The negative effects attributable to the end mounting of the tool are virtually eliminated.

It should be noted that in the drawings the size of certain features have been greatly exaggerated in order to make it possible to show them. These features include the recesses that form part of the bearings 28, 29, 70, 71, 80, and 81; the clearance 96; and the gap between flange 79 and gland 78. Each of these features is measured in 0.0001 of an inch; for example, the gap between flange 79 and gland 78 is approximately 0.0003 inch (when the pressurizing fluid is air). It would obviously be impossible to show these features in the drawings without exaggerating their smallest dimensions.

It is to be realized that the present invention may be embodied in other than the specific apparatus and procedures illustrated and described herein. It is intended that the specific disclosure contained herein, which is of preferred embodiments and the best modes of the invention presently known to the inventor, is to be considered as illustrative and not in a limiting sense. The scope and content of the invention are to be determined by the appended claims.

I claim:

1. Apparatus for supporting an object while it is being dressed and for moving the object relative to dressing means positioned to be contacted by a side portion of the object during axial travel of the object, comprising:

a vertically oriented support assembly that includes a piston member, and a cylinder member having an open end into which the piston member is received; one of said members being movable and having a pressure surface, and the other of said members being fixed; and said members defining a variable volume chamber therebetween, with at least a portion of said chamber being below said pressure surface;

mounting means for securing the object in a vertical position to an outer end portion of said movable member;

supply means for continously supplying pressurized fluid into said chamber and to said pressure surface to exert an upward force on said movable member that is less than the combined weight of said movable member and the object secured thereto by a predetermined amount to thereby counterbalance a portion of said combined weight;

moving means for exerting an additional upward force on said movable member to move said movable member and said object axially upwardly;

leak means for allowing the pressurized fluid supplied to said pressure surface to leak away from said pressure surface to in turn allow the downward force of said combined weight alone, without the application of any other downward force, to move said movable member and said object axially downwardly at a controlled rate upon removal of the additional upward force of the moving means; and pressurized fluid bearing means between said piston member and said cylinder member.

2. Apparatus as described in claim 1, in which the piston member is movable, and the cylinder member is fixed.

3. Apparatus for supporting an object while it is being dressed and for moving the object relative to dressing means positioned to be contacted by a side portion of the object during axial travel of the object, comprising:

a vertically oriented piston having a lower postion and a pressure surface;

mounting means for securing the object in a vertical position to one end of the piston;

a cylinder having an open end into which the piston is received with said one end of the piston projecting outwardly from said open end of the cylinder; said cylinder and said piston defining a variable volume chamber therebetween, with at least a portion of said chamber being below the pressure surface;

supply means for continuously supplying pressurized fluid into said chamber and to the pressure surface, said supply means having first and second modes;

with said pressurized fluid, when the supply means is in its first mode, exerting an upward force on the pressure surface that is sufficient to overcome the combined weight of the piston and the object and to move the piston and the object axially upwardly and the piston away from its lower position; and with said pressurized fluid, when the supply means is in its second mode, exerting an upward force on the pressure surface that is less than said combined weight by a predetermined amount, to counterbalance a portion of said combined weight, and to allow the downward force of said combined weight alone, without the application of any other downward force, to move the piston and the object axially downwardly at a controlled rate when the piston is above its lower position; and leak means for allowing the pressurized fluid to leak out of said chamber and away from the pressure surface as the piston and the object move downwardly.

4. Apparatus as described in claim 3, further comprising pressurized fluid bearing means between the piston and the cylinder.

5. Apparatus as described in claim 4:

in which the mounting means is positioned to secure the object to said one end of the piston with the longitudinal axis of the object coincident with the axis of the piston; and further comprising guide means for producing and guiding rotational movement of the object during axial travel of the object.

6. Apparatus as described in claim 4, in which:

the piston has a smooth cylindrical outer surface adjacent to inner portions of the cylinder;

the fluid bearing means is carried by said inner portions of the cylinder; and the leak means includes an exhaust passageway extending through a wall portion of the cylinder, radially adjacent to the piston and a land portion of the cylinder, said land portion having a first end adjacent to said chamber and a second end adjacent to said exhaust passageway.

7. Apparatus as described in claim 4, in which:

the cylinder has a smooth cylindrical inner surface adjacent to outer portions of the piston;

the fluid bearing means is carried by said outer portions of the piston; and the leak means includes an exhaust passageway extending through the piston, and a land portion of the piston, said land portion having a first end adjacent to said chamber and a second end adjacent to one end of the exhaust passageway.

8. Apparatus as described in claim 7, further comprising means for supplying pressurized fluid to the fluid bearing means, including:

a supply passageway extending through the piston and communicating with the fluid bearing means, said supply passageway having a receiving end extending through a side portion of the piston adjacent to said one end of the piston; and an annular gland rotatably mounted on the piston, said gland including passageway means communicating with said receiving end of the supply passageway, means to connect a supply line to communicate with said passsgeway means, and second pressurized fluid bearing means to allow essentially friction free rotational motion of the piston relative to the gland, said second pressurized fluid bearing means communicating with said passageway means and being supplied with pressurized fluid through said passageway means.

9. Apparatus as described in claim 4, in which the fluid bearing means comprises at least two axially spaced paired step air bearings.

10. Apparatus as described in claim 3, in which the supply means includes restrictor means to control the rate of increase in pressure of the pressurized fluid supplied to the piston.

11. Apparatus for supporting a tool element while it is being ground, and for moving such tool element relative to a grinding element positioned to be contacted by a side portion of the tool element during axial travel of the tool element, comprising:

a vertically oriented support assembly that includes a piston member, and a cylinder member having an open end into which the piston member is received; one of said members being movable and having a pressure surface, and the other of said members being fixed; and said members defining a variable volume chamber therebetween, with at least a portion of said chamber being below said pressure surface;

means on an outer end portion of said movable member for receiving a tool element to be ground with the axis of said tool element disposed vertically;

supply means for continuously supplying pressurized fluid into said chamber and to said pressure surface to exert an upward force on said movable member that is less than the combined weight of said movable member and said tool element by a predetermined amount to thereby counterbalance a portion of said combined weight;

moving means for exerting an additional upward force on said movable member to move said movable member and said tool element axially upwardly; and leak means for allowing the pressurized fluid supplied to said pressure surface to leak away from said pressure surface to in turn allow the downward force of said combined weight alone to move said movable member and said tool element axially downwardly at a controlled rate upon removal of the additional upward force of the moving means, without the application of any other downward force.

12. Apparatus as described in claim 11, in which the piston member is movable, and the cylinder member is fixed.

13. Apparatus as described in claim 11, in which the leak means is always open to allow an operator to cause said movable member and said tool element to be moved axially downwardly by said combined weight simply by removing said additional upward force.

14. Apparatus as described in claim 11, further comprising pressurized fluid bearing means between the piston member and the cylinder member.

15. Apparatus as recited in claim 14:

in which the means for receiving the tool element is positioned to receive the tool element with the longitudinal axis of the tool element coincident with the axis of the movable member; and further comprising guide means for producing and guiding rotational movement of the tool element during axial travel of the tool element.

16. Apparatus as recited in claim 14, in which the fluid bearing means comprises at least two axially spaced paired step air bearings.

17. Apparatus as described in claim 14, in which the leak means includes a leak passageway defined by radially closely adjacent portions of the piston member and the cylinder member, and said leak means is always open to allow an operator to cause said movable member and said tool element to be moved axially downwardly by said combined weight simply by removing said additional upward force.

18. Apparatus as described in claim 17, in which:

the piston member has a smooth cylindrical outer surface adjacent to inner portions of the cylinder member;

the fluid bearing means is carried by said inner portions of the cylinder member; and the leak means includes an exhaust passageway extending through a wall portion of the cylinder member radially adjacent to the piston member; and said portions defining said leak passageway include a land portion of the cylinder member, said land portion having a first end adjacent to said chamber and a second end adjacent to said exhaust passageway, and portions of said outer surface of the piston member.

19. Apparatus as described in claim 17, in which:

the cylinder member has a smooth cylindrical inner surface adjacent to outer portions of the piston member;

the fluid bearing means is carried by said outer portions of the piston member; and the leak means includes an exhaust passageway extending through the piston member; and said portions defining said leak passageway include a land portion of the piston member, said land portion having a first end adjacent to said chamber and a second end adjacent to one end of the exhaust passageway, and portions of said inner surface of the cylinder member.

20. Apparatus as described in claim 19:

in which the piston member is movable, and the cylinder member is fixed; and which further comprises means for supplying pressurized fluid to the fluid bearing means, including:

a supply passageway extending through the piston member and communicating with the fluid bearing means, said supply passageway having a receiving end extending through a side portion of the piston member adjacent to said outer end portion of the piston member; and an annular gland rotatably mounted on the piston member, said gland including passageway means communicating with said receiving end of the supply passageway, means to connect a supply line to communicate with said passageway means, and second pressurized fluid bearing means to allow essentially friction free rotational motion of the piston member relative to the gland, said second pressurized fluid bearing means communicating with said passageway means and being supplied with pressurized fluid through said passageway means.

21. Apparatus as described in claim 11, in which the moving means comprises means for increasing the pressure of the pressurized fluid supplied by the supply means to cause said pressurized fluid to exert said additional upward force on said movable member.

22. Apparatus as described in claim 21, in which the supply means includes restrictor means for controlling the rate of increase in the pressure of the pressurized fluid to ensure a gradual increase in pressure.

23. Apparatus as described in claim 21, in which the leak means is always open to allow an operator to cause said movable member and said tool element to be moved axially downwardly by said combined weight simply by decreasing the pressure of said pressurized fluid.

24. Apparatus as described in claim 21, further comprising pressurized fluid bearing means between the piston member and the cylinder member.

25. Apparatus for supporting a tool element while it is being ground, and for moving such tool element relative to a grinding element positioned to be contacted by a side portion of the tool element during axial travel of the tool element, comprising:

a vertically oriented support assembly that includes a piston member, and a cylinder member having an open end into which the piston member is received; one of said members being movable and having a pressure surface, and the other of said members being fixed; and said members defining a variable volume chamber therebetween, with at least a portion of the chamber being below said pressure surface;

means on an outer end portion of said movable member for receiving a tool element to be ground with the axis of said tool element disposed vertically;

supply means for continuously supplying pressurized fluid into said chamber and to the pressure surface, said supply means having first and second modes; with said pressurized fluid, when the supply means is in its first mode, exerting an upward force on the pressure surface that is sufficient to overcome the combined weight of said movable member and said tool element and to move said movable member and said tool element axially upwardly; and with said pressurized fluid, when the supply means is in its second mode, exerting an upward force on the pressure surface that is less than said combined weight by a predetermined amount, to counterbalance a portion of said combined weight;

pressurized fluid bearing means between said piston member and said cylinder member; and leak means for allowing the pressurized fluid supplied to the pressure surface to leak away from the pressure surface to in turn allow the downward force of said combined weight alone, without the application of any other downward force, to move said movable member and said tool element axially downwardly at a controlled rate when the supply means is in its second mode; said leak means including a leak passageway defined by radially closely adjacent portions of the piston member and the cylinder member; and said leak means being always open to allow said pressurized fluid to leak away from the pressure surface regardless of the mode which the supply means is in, to in turn allow an operator to cause said movable member and said tool element to be moved axially downwardly by said combined weight simply by changing the supply means from its first to its second mode.

* * * * *